United States Patent [19]

Holzer

[11] Patent Number: 4,595,451

[45] Date of Patent: Jun. 17, 1986

[54] PROCESS AND APPARATUS FOR ETCHING PRINTED CIRCUIT BOARDS

[76] Inventor: Walter Holzer, Drosteweg 19, Meersburg, Fed. Rep. of Germany, 7758

[21] Appl. No.: 681,382

[22] Filed: Dec. 13, 1984

[30] Foreign Application Priority Data

Dec. 13, 1983 [DE] Fed. Rep. of Germany ..... 3345050

[51] Int. Cl.[4] ..... C23F 1/00; B44C 1/22; C03C 15/00; C03C 25/06

[52] U.S. Cl. ..... 156/627; 156/345; 156/637; 156/642; 156/666; 156/901; 204/186; 204/302

[58] Field of Search ..... 156/637, 638, 642, 659.1, 156/656, 666, 901, 902, 345, 627; 134/3, 41, 34, 101, 108, 198; 204/129.1, 129.2, 129.6, 129.65, 129.7, 186, 302

[56] References Cited

U.S. PATENT DOCUMENTS

| | | | |
|---|---|---|---|
| 3,880,409 | 4/1975 | Bok et al. | 156/637 X |
| 4,073,708 | 2/1978 | Hicks | 156/642 X |
| 4,482,425 | 11/1984 | Battey | 156/637 |

*Primary Examiner*—William A. Powell
*Attorney, Agent, or Firm*—Louis E. Marn; J. C. Jangarathis

[57] ABSTRACT

There is disclosed a process and apparatus for etching printed board circuits wherein etching of a printed circuit board is effected in turbulent flow of the etching solution and wherein concentration of the etching solution is maintained at effective levels by electrolysis.

25 Claims, 3 Drawing Figures

PROCESS AND APPARATUS FOR ETCHING PRINTED CIRCUIT BOARDS

FIELD OF THE INVENTION

This invention relates to an improved process and apparatus for etching printed board circuits, and more particularly to an improved process and apparatus for etching printed board circuits substantially eliminating concomitant environmental problems resulting therefrom.

BACKGROUND OF THE INVENTION

The etching of printed circuit boards has evolved to the point where known spray etching processes are expensive and not suitable for small installations or selective use. The handling of etching solutions and the disposal of spent etching solutions present environmental problems.

OBJECTS OF THE INVENTION

An object of the present invention is to provide an improved process and apparatus for etching printed board circuits.

Another object of the present invention is to provide an improved process and apparatus for etching printed board circuits substantially eliminating environmental problems associated with handling etching solutions.

Yet another object of the present invention is to provide an improved process and apparatus for etching printed board circuits providing for in situ regeneration of etching solutions at effective concentration levels.

A further object of the present invention is to provide an improved process and apparatus for etching printed board circuits permitting on-stream operating conditions with minimal, if any, personnel requirements.

A still further object of the present invention is to provide an improved process and apparatus for etching printed board circuits environmentally safe in a shut-down condition.

Still another object of the present invention is to provide an improved process and apparatus for etching printed board circuits allowing for efficacious removal of copper from the etching solution.

Still yet another object of the present invention is to provide an improved process and apparatus for etching printed board circuits permitting of safe and efficacious removal of residual etching chemicals.

Another object of the present invention is to provide an improved process and apparatus for etching printed board circuits in an essentially environmentally safe on-stream or shut-down mode.

A further object of the present invention is to provide an improved process and apparatus for etching printed board circuits which is comparable in intensity to spray etching techniques.

SUMMARY OF THE INVENTION

These and other objects of the present invention are achieved by a process and apparatus for etching printed board circuits wherein etching of a printed circuit board is effected in turbulent flow of the etching solution and wherein concentration of the etching solution is maintained at effective levels by electrolysis.

BRIEF DESCRIPTION OF THE DRAWINGS

A better understanding of the present invention as well as other objects and advantages thereof will be come apparent upon consideration of the detailed disclosure thereof, especially when taken with the accompanying drawings, wherein.

DETAILED DESCRIPTION OF THE INVENTION

It is to be understood that certain equipment, such as valves, electric circuitry, indicators, and the like have been omitted from the drawings to facilitate the description hereof and the placing of such equipment at appropriate locations is deemed to be within the scope of one skilled in the art.

Figure 1:
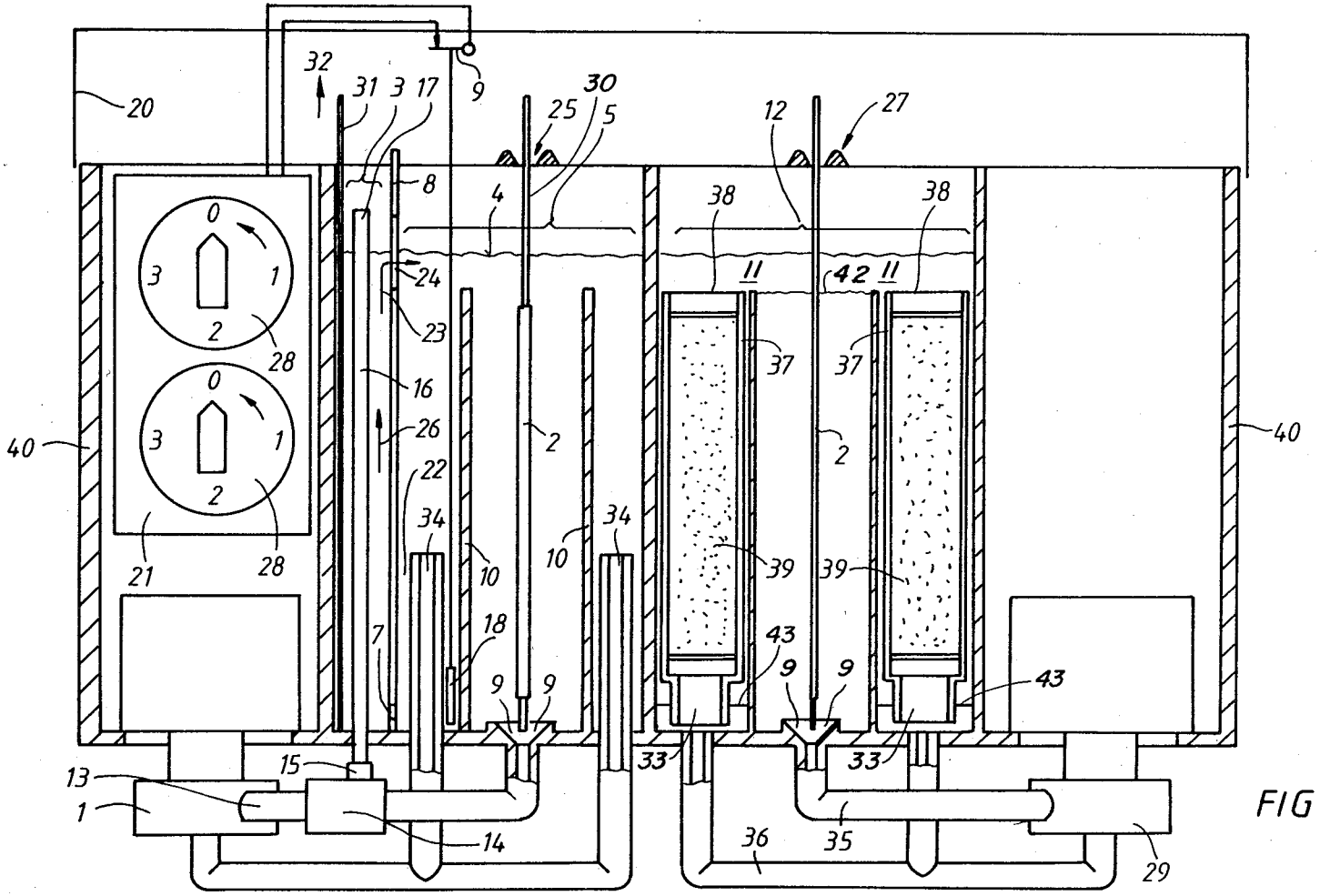
FIG. 1 is an elevational view, partially in cross-section, of the apparatus of the present invention.

Referring to the drawings, and particularly FIG. 1, there is illustrated a vessel 40 including a plurality of intermediate walls defining, inter alia, an electrolytic cell 3, an an etch chamber 5 and a rinse chamber 12, enclosed by a lid or cover 20. Proximate the electrolytic cell 3, there is provided a chamber in which are positioned a circuit box 21 including timers 28 and a motor for a pump 1. Proximate the rinse chamber 12, there is provided a chamber in which is positioned a motor for a pump 29.

The pump 1 is provided with a discharge conduit 13 in fluid communication with an ejector 14 including a suction conduit 15. The discharge end of the ejector 14 is in fluid communication with a nozzle disposed in a lower portion of the etch chamber 5. The suction side of the pump 1 is in fluid communication with vertically-disposed conduits including inlet orifice 34 positioned in the etch chamber 5 between the nozzle disposed in the lower portion of the etch chamber 5.

The pump 29 is provided with a discharge conduit 35 in fluid communication with a nozzle disposed in a lower portion of the rinse chamber 12 with the suction side of pump 29 being in fluid communication by conduits 36 with the rinse chamber 12, as more fully hereinafter discussed.

The electrolytic cell 3 includes a cathode plate 31 and an anode plate 8 laterally-disposed within the vessel 40. The anode plate 8 includes an orifice 7 formed in a lower portion thereof and an orifice 24 disposed in an upper portion thereof, as will be more fully hereinafter discussed. The cathode 31 and anode 8 are connected by appropriate conductors (not shown) to circuit box 21. Disposed between the cathode 31 and the anode 8, there is provided a vertically-disposed conduit 16 including an upper inlet orifice 17.

The etch chamber 5 is provided with intermediate side walls of a predetermined height positioned intermediate the nozzle provided in the lower portion thereof and laterally-disposed therein thereby defining an etching zone for positioning therein, a printed circuit board 2 to be treated including a holder 30. Support elements defining a slot 25 are provided in an upper portion of the etching zone in vertical alignment with the nozzle provided in the lower portion of the etching zone of the etch chamber 5. Between the upright conduit including inlet orifice 34 and the intermediate side wall 10, proximate the electrolytic cell 3 and below the inlet orifice 34 thereof, there is provided a float member 18 of a preselect specific gravity connected to a switching means including a lever 9, as more fully hereinafter described.

The rinse chamber 12 is formed with intermediate side walls 41 of a predetermined height positioned on either side of the nozzle provided in the lower portion thereof and defining a rinsing zone for a treated printed circuit board 2. Support elements defining a slot 27 are provided in an upper portion of the rinsing zone of the rinse chamber 12 in vertical alignment with the nozzle provided in the lower portion thereof. Between the intermediate side walls 11 and the side walls defining the rinse chamber 12 there are provided cartridge receiving chambers for positioning cartridges 37 provided with combined anionic and cationic exchange resins.

In operation, a circuit board 2 to be etched is lowered by holder 30 through the slot 25 formed by the supporting element into an etching solution (of a liquid level 4) in the etching zone of the etch chamber 5. Energizing of the motor driving the pump 1 causes etching solution in the etch chamber 5 to be drawn via the inlet orifices 34 of the conduits disposed therein to the suction side of the pump 1. Pressurized etching solution is discharged from the pump 1 via conduit 13 into ejector 14 wherein the pressurized etching solution is admixed with a gaseous stream in conduit 17 with the combined gaseous-liquid stream introduced via the nozzle in the lower portion of the etching zone is turbulent fluid flow against the printed circuit board to be etched. Such turbulent fluid flow (i.e. kinetic energy of turbulent flow) substantially improves the rate of etching of the printed circuit board by removal of copper therefrom in the form of copper cations. Simultaneously with the energizing of the pump 1, a timer 28 is set to effect duration of operation of the pump 1 to a preselect time of desired etching of the printed circuit board 2.

Proper concentration of the etching solution, and in particular concentration of the copper cations, is constantly monitored by the float 18 having a predetermined specific gravity. Should the concentration of copper reach a maximum copper content, the float 18 activates a switch via the lever 9 to place a potential across the cathode 31 and the anode 9 whereby copper cations are deposited or plated as copper on the cathode 31 and oxygen and ammonia are generated at the anode 8. It will be appreciated during the operation of the pump 1 that a gaseous stream is drawn via the inlet 17 of the conduit 16, and that oxygen and ammonia will comprise a portion of such gaseous stream when an electric potential is placed across the cathode 31 and anode 8 of the electrolytic cell 3. Upward flow of the oxygen and ammonia assists in the flow of etching solution through the electrolytic cell 5. Introduction of oxygen and ammonia into the recirculating stream of etching solution regenerates the capacity of the etching solution during etching of the printed circuit board.

Upon reaching a predetermined minimum concentration of copper cations in the etching solution, the float 18 causes the electric circuit placing an electric potential across the cathode 31 and anode 8 to open thereby discontinuing electrolysis of the etching solution in the electrolytic chamber. It will be noted for efficacious operation of the float 18, that the float 18 is disposed in a substantial quiescent zone of the etch chamber 5 thereby to minimize the effects of eddy currents therein which could effect proper concentrations of the etching solution.

A side stream of the etching solution through the electrolytic cell 3 is effected concurrently with the flow of circulating fluid through the etch chamber 5, i.e. upwardly from the nozzle via jets 9 about the printed circuit boards over the top portion of intermediate side walls 10 and downwardly into the chambers in which are disposed the conduits including inlet orifices 34. Such fluid flow, together with upward evolution of oxygen and ammonia and flow supported by copper deposition in the cathode, causes a portion of the downwardly flowing etching solution to enter via orifice 7 into the electrolytic cell 3 and flow via orifice 24 into the etching chamber 24 as illustrated by the arrows 26 and 23, it being noted that the fluid level 4 in the etch chamber 5 is maintained above the lower portion of the orifice 24. It will be further noted that the anode 8 conveniently constitutes a separating wall between the electrolytic cell 3 and the etching chamber 5. When desired or as monitored, the cathode 31 is removed and replaced to ensure economic and efficient operation of the electrolytic cell 3. A substantial advantage of the present invention is the maintenance of the concentration of the etching solution for effective etching without other dosaging means effected by admixing of generated oxygen and ammonia with recycled etching solution in ejector 14. The process is preferably designed with excess electrolytic capacity to ensure proper concentration levels of the etching solution.

Figure 2:
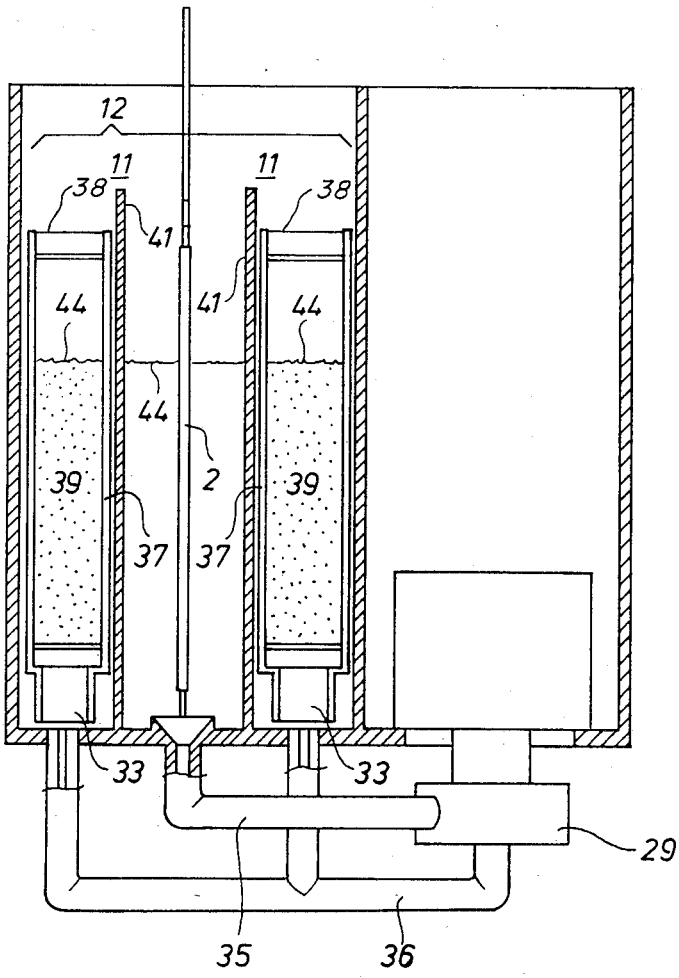
FIG. 2 is an elevational view, partially in cross-section, of a rinse chamber thereof in a shut-down mode.

After a predetermined time period of etching, as evidenced by the timer 28 being opened, the etched circuit board 2 is withdrawn by holder 30 from the etch chamber 5 and introduced into a rinse or wash liquor in the rinse chamber 12 via slot 27 formed by support elements disposed vertically above the nozzle disposed in the lower portion thereof. Concomitantly, a printed circuit board 2 to be treated may be positioned in the etch chamber 5, referring now to FIG. 2. FIG. 2 illustrates the rinse chamber in a shut-down mode with a liquor level 44 therein. In such state, the ion exchange resins 39 are in contact with the liquor to prevent drying out of the resin in such a shut-down mode.

Figure 3:
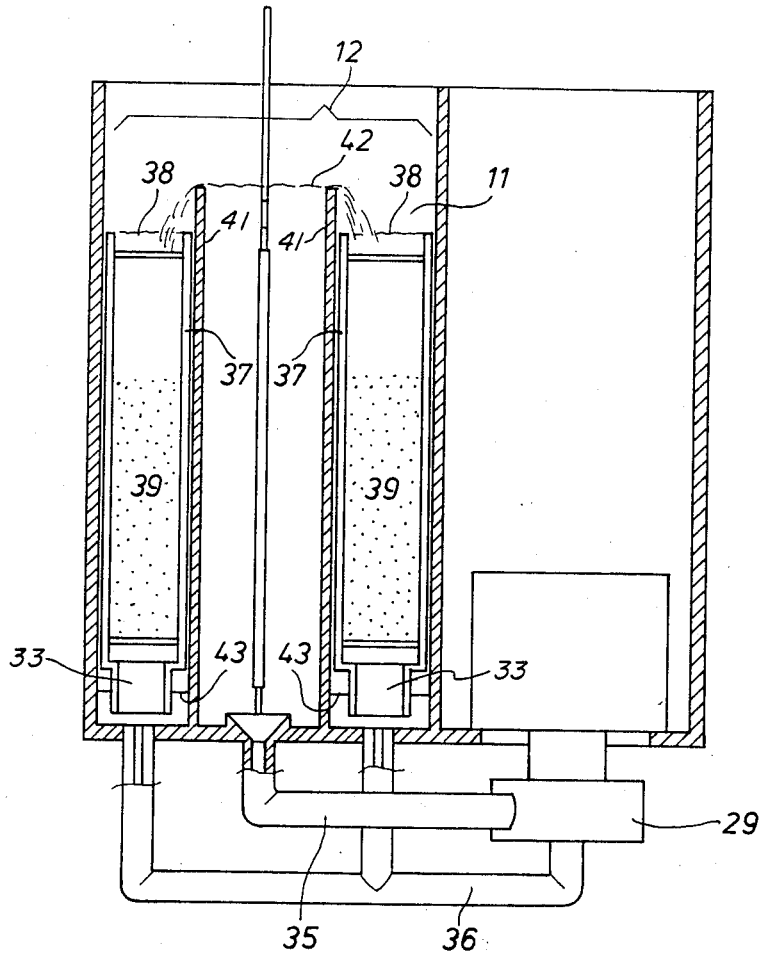
FIG. 3 is an elevational view, partially in cross-section, of the rinse chamber in an on-stream mode.

Referring now to FIG. 3, the motor associated with the pump 29 is energized to effect fluid flow of rinse or wash liquor via conduit 36 to the suction side of the pump 29 with pressurized liquor being introduced into the rinse chamber 12 via the nozzle in turbulent flow (i.e. use of kinetic energy) against the etched circuit board 2 improves removal of residual cations including copper cations as well as residual anions, e.g. ammonium and the like. The rinse or wash liquor upwardly introduced into the rinse chamber 12 about the etched circuit board rises and overflows the top portion of intermediate side walls into the chambers in which are disposed the cartridges 37 including the ion exchange resins 39 wherein there is maintained a liquid level 43 in an essentially pressureless return flow of rinse or wash liquor to enhance removal of harmful or deleterious chamicals. The cartridges 37 are shaped to permit liquid flow thereabout, i.e. recycling liquor not passing through the ion exchange resins 39, to minimize any problems which might occur by plugging or sealing of the cartridges 37 containing the ion exchange resins 39.

The cartridge 37 is preferably formed of a transparent or translucent material, with ion exchange resins 39 being preferably formed of a material which by color change illustrates saturation of the ion exchange resins, and thus replacement of one or more cartridges.

It will be appreciated by one skilled in the art that the process and apparatus of the present invention permits etching of printed circuit boards substantially eliminating environmental problems created by any requirements of disposing of spent etching solutions, i.e. by the existence of a system for regenerating etching solution during etching, particularly where the regenerating capability is in excess of etching capability. The process and apparatus of the present invention is particularly feasible for small installations, and in particular for electronic stores for do-it-yourself usage. Additionally, the process and apparatus of the present invention permits usage by one not skilled in the art of etching together with operational safety and available environmental immersions process in an essentially breakdown-free system since closed cycles processes are used.

The configuration of the anode 8 including number and sizing of orifices 7 and 24 as well as anode material may be selected as determined by processing requirements wherein a slow fluid flow is desired through the electrolytic cell 3 to aid in copper deposition. Additionally, the anode 8 may be positioned in a sliding relationship to permit raising and lowering thereof thereby permitting the altering of the intensity of the flow of the etching solution through the electrolytic cell 3. It will be also appreciated by one skilled in the art that the process and apparatus of the present invention is effected in one vessel or container. Still further, the rinse cycle is designed to minimize discharge of any rinse medium to the environment, and permits safe handling of spent ion exchange resins included in replaceable cartridges.

While the invention has been described in connection with an exemplary embodiment thereof, it will be understood that many modifications will be apparent to one of ordinary skill in the art, and that this application is intended to cover any adaptations or variations thereof. Therefore, it is manifestly intended that this invention be only limited by the claims and the equivalents thereof.

What is claimed:

1. In a process for etching a printed circuit board by immersion in an etching solution, the improvement comprising:

contacting in an etching zone said printed circuit board with a stream of etching solution in turbulent flow to effect etching of said printed circuit board; and electrolyzing in an electrolyzing zone said etching solution whereby copper is plated out on an electrode, said etching zone being in fluid flow communication with said electrolyzing zone and wherein thermodynamic flow of liquid is enhanced by deposition of copper and generation of gases therein.

2. The improved process as defined in claim 1 wherein said gases are admixed with recycled etching solution prior to the step of contacting said printed circuit board with a stream of etching solution.

3. The improved process as defined in claim 1 wherein capacity for electrolyzing said etching solution is greater than capacity for etching.

4. The improved process as defined in claim 1 wherein the step of electrolysis is initiated by a preselect maximum concentration of copper ions.

5. The improved process as defined in claim 4 wherein electrolysis is discontinued at a preselect minimum concentration of copper ions.

6. The improved process as defined in claims 1 or 4 wherein concentration of coppers ions is sensed in a quiescent zone of said electrolyzing zone.

7. In an apparatus for etching a printed circuit board in an etch chamber by immersion in an etching solution including means for positioning a printed circuit board therein, the improvement comprising:

pump means for pressurizing an etching solution;

first conduit means in fluid communication with a discharge size of said pump means;

an ejector disposed in said first conduit means;

nozzle means in fluid communication with said first conduit means and disposed in said etch chamber for directing pressurized etching solution in turbulent flow against said printed circuit board;

second conduit means in fluid communication with a suction side of said pump means for withdrawing etching solution from said etch chamber; and third conduit means in fluid communication with a suction side of said ejector and having an inlet above a level of said etching solution in said etch chamber.

8. The apparatus as defined in claim 7 and further including an electrolysis chamber including a cathode and an anode and means for introducing etching solution into said electrolysis chamber from said etch chamber.

9. The apparatus as defined in claim 8 and further including switching means for placing an electric potential across said cathode and said anode.

10. The apparatus as defined in claim 9 wherein said switch means is closed in response to a preselect maximum concentration of copper ions in said etching solution.

11. The apparatus as defined in claim 10 wherein said switching means is open in response to a preselect minimum concentration of copper ions in said etching solution.

12. The apparatus as defined in claim 8 wherein said third conduit means is positioned in said electrolytic chamber.

13. The apparatus as defined in claims 9 or 10 and further including sensor means connected to said switching means responsive to specific gravity of said etching solution.

14. The apparatus as defined in claim 13 wherein said sensor means is disposed beneath an inlet orifice of said second conduit means proximate said anode.

15. The apparatus as defined in claim 14 wherein said sensor means is positioned proximate said means for introducing etching solution into said electrolysis chamber.

16. The apparatus as defined in claim 8 wherein said etch chamber and electrolysis chamber are separated by a separating means including said means for introducing etching solution into said electrolysis chamber from said etch chamber.

17. The apparatus as defined in claim 16 wherein said separating means is said anode.

18. The apparatus as defined in claim 17 wherein said anode includes orifices as said means for introducing etching solution into said electrolysis chamber from said etch chamber.

19. The apparatus as defined in claim 7 and further including:

a rinse chamber including positioning means for positioning an etched circuit board;

pump means for pressurizing a rinse solution;

first rinse conduit means in fluid communication with a discharge side of said pump means; and nozzle means in fluid communication with said first rinse conduit means and disposed in said rinse chamber for directing pressurized etching solution in turbulent flow against said etched circuit board.

20. The apparatus as defined in claim 19 and further including ion exchange resins disposed in said rinse chamber.

21. The apparatus as defined in claim 20 wherein said ion exchange resins are contained in cartridge means.

22. The apparatus as defined in claim 21 wherein said cartridge means are at least partially transparent and said ion exchange resin is color responsive.

23. The aparatus as defined in claim 19 and further including second rinse conduit means in fluid communication between said rinse chamber and a suction side of said pump means.

24. The apparatus as defined in claim 23 wherein said conduit means and said rinse chamber are dimensioned to provide a liquid level in said rinse chamber higher than a liquid level above an inlet orifice of said second rinse conduit means.

25. The apparatus as defined in claim 19 wherein said chambers are formed in a unitary vessel.

* * * * *